US007789163B2

(12) United States Patent
Kratochvil et al.

(10) Patent No.: US 7,789,163 B2
(45) Date of Patent: Sep. 7, 2010

(54) DUAL-STAGE VALVE STRADDLE PACKER FOR SELECTIVE STIMULATION OF WELLS

(75) Inventors: Robert Kratochvil, Calgary (CA); Scott Kirk, Calgary (CA); Dan Schofield, Calgary (CA); Darko Smolcic, Calgary (CA)

(73) Assignee: Extreme Energy Solutions, Inc., Calgary, AB (CA)

( * ) Notice: Subject to any disclaimer, the term of this patent is extended or adjusted under 35 U.S.C. 154(b) by 22 days.

(21) Appl. No.: 12/003,269

(22) Filed: Dec. 21, 2007

(65) Prior Publication Data

US 2009/0159299 A1 Jun. 25, 2009

(51) Int. Cl.
*E21B 33/124* (2006.01)

(52) U.S. Cl. ..... 166/387; 166/177.5; 166/188; 166/202

(58) Field of Classification Search ..... 166/177.5, 166/308.1, 188, 191, 202
See application file for complete search history.

(56) References Cited

U.S. PATENT DOCUMENTS

| | | | | |
|---|---|---|---|---|
| 2,227,731 | A | 1/1941 | Lynes | |
| 2,607,424 | A | 8/1952 | Taylor | |
| 2,851,109 | A * | 9/1958 | Spearow | 166/177.5 |
| 3,020,960 | A * | 2/1962 | Hayward | 166/146 |
| 3,648,777 | A | 3/1972 | Arterbury et al. | |
| 3,760,878 | A * | 9/1973 | Peevey | 166/185 |
| 3,861,465 | A * | 1/1975 | Mignotte | 166/255.1 |
| 4,103,741 | A * | 8/1978 | Daigle | 166/147 |
| 4,569,396 | A * | 2/1986 | Brisco | 166/305.1 |
| 4,590,995 | A | 5/1986 | Evans | |
| 5,383,520 | A | 1/1995 | Tucker et al. | |
| 5,782,306 | A * | 7/1998 | Serafin | 166/387 |
| 6,533,037 | B2 * | 3/2003 | Eslinger et al. | 166/319 |
| 6,655,461 | B2 | 12/2003 | Eslinger et al. | |
| 6,776,239 | B2 * | 8/2004 | Eslinger et al. | 166/308.1 |
| 6,782,954 | B2 * | 8/2004 | Serafin et al. | 166/387 |
| 6,883,610 | B2 * | 4/2005 | Depiak | 166/308.1 |
| 7,051,812 | B2 | 5/2006 | McKee et al. | |
| 7,114,574 | B2 * | 10/2006 | Bissonnette et al. | 166/386 |
| 2006/0000620 | A1 * | 1/2006 | Hamilton | 166/387 |

* cited by examiner

*Primary Examiner*—David J. Bagnell
*Assistant Examiner*—Blake Michener
(74) *Attorney, Agent, or Firm*—Diederiks & Whitelaw, PLC

(57) ABSTRACT

A straddle packer which, when in place during a fracing or well stimulation service, isolates the fracing zone from zones in the wellbore above and below the fracing zone, and which when run into the wellbore provides an open passageway from below the packer to the tubing string, relieving built up fluid pressure below the tool and permitting insertion at relatively high speeds.

4 Claims, 2 Drawing Sheets

DUAL-STAGE VALVE STRADDLE PACKER FOR SELECTIVE STIMULATION OF WELLS

FIELD OF THE INVENTION

The present invention provides for a novel packing tool for isolation of a portion of a wellbore subject to high pressure fracturing operations from the rest of the wellbore.

More particularly, the present invention relates to such a packing tool which can be efficiently run into the wellbore in the presence of included fluids and or high pressure.

BACKGROUND OF THE INVENTION

In the fracturing and stimulation of wells in the oil and gas extraction industry, it is common to desire that the zone to be stimulated be segregated from zones both below and above during the fracturing or stimulation operation. This is typically done by placing packers on the tubing string being used for the fracturing or stimulation operation to seal the annulus between the string and the casing at points below and above the portion of the tubing string through which high pressure fluids (with or without additives) are injected into the wellbore and through production ports in the well's casing, into the production zone, to effect the desired well stimulus. Often, if the well contains water or similar fluid, either naturally or from a prior operation, the insertion of the packer-equipped tubing from surface to the desired part of the wellbore is slowed tremendously (from the usual 25 meters per minute to as slow as one meter per minute) because that fluid must pass by the packer as the tubing string is lowered into the well.

It is, therefore, desirable to provide a new packing tool to overcome the disadvantages of the prior art.

SUMMARY OF THE INVENTION

It is an object of the present invention to obviate or mitigate at least one disadvantage of previous segregation packers used in fracturing or stimulating a well using high pressure fluids, with or without additives.

This invention provides for a valve which when run down a wellbore opens a passage to bypass the lower seals of the tool through which passageway water or similar fluid in the wellbore may pass as the tubing and packing tool are lowered down the well-bore through the water or similar fluid, and which can selectively be closed when the packer and tubing string is placed where desired, thus providing isolation of a fracing zone from zones both above and below the stimulation operation. This permits the tool to be run into a wellbore through fluids in the wellbore without the usual hydraulic resistance encountered when using a tool from the prior art.

The invention, in one embodiment, provides a straddle packer with a dual stage valve which opens and closes a fluid passageway, comprising i. a drag body connected to a hollow mandrel;

ii. the hollow mandrel, open at one end to the wellbore below the straddle packer, with an outer surface;

iii. slideably fit into a matching cavity in the straddle packer's lower body;

iv. the cavity configured to be operatively sealed with the outer surface of the hollow mandrel, and with a port which, when the packer is open, communicates between the mandrel's hollow to the wellbore below the tool and through the cavity and then the body to the annulus between the packer and the wellbore, and which, when the packer is closed, is configured such that the port is sealed by the sealed interface between the outer surface of the hollow mandrel and the inner surface of the body's cavity; and v. the sliding motion between the opening and closing positions of the port being motivated by force exerted by friction between the drag body and the wellbore's casing when the packer is moved, such that a downward movement of the packer slides the mandrel and opens the port, while upward movement of the packer closes the port.

In a further embodiment is provided a dual-stage valve straddle packer for insertion into a wellbore and delivery of fracing and stimulation service to a particular zone of the wellbore comprising:

i. a body operatively connected to a tubing string, with fluid communication to the inner bore of the tubing;

ii. the body having an upper cup-seal for isolation of fluid delivered under pressure through fracing ports in the body below that seal by sealing the annulus between the body and the wellbore's casing;

iii. the body having a set of lower cup-seals for isolation, by a top lower cup-seal of the fracing ports from the wellbore below the top lower seal, and by a bottom lower cup-seal of the wellbore below the bottom lower seal from the fracing ports, the cup-seals being essentially one-way seals sealing a higher pressure side from a lower pressure side, the seals deployed to seal the annulus between the body and the wellbore's casing;

iv. a passageway from the wellbore below the bottom lower seal through the body and a valve to ports in the body in fluid communication when the valve is open with the annulus between the body and the wellbore's casing at a point above the bottom lower seal and below the upper seal; and v. the valve being capable of opening and closing, responsive to a movement of the body in the wellbore, where an upward movement will close the valve and a downward movement will open the valve.

In a further embodiment the valve is a pressure balanced valve. In a further embodiment is provided a method of inserting a straddle packer for isolation of a fracing service in a zone from zones in a wellbore above and below the fracing zone, comprising the steps:

i. where the straddle packer has three uni-directional seals, sealing flow from high pressure side to low pressure side, the uppermost seal sealing the low pressure wellbore zone above the tool from a high pressure fracing zone below the uppermost seal; a middle seal sealing the high pressure fracing zone above the middle seal from a low pressure wellbore zone below the seal, and a lowermost seal sealing a high pressure wellbore zone below the lowermost seal from flowing around the middle seal, when lower pressure exists between the two uppermost seals, otherwise a seal will not act as a seal;

ii. inserting the straddle packer into a wellbore, and applying a downhole force;

iii. which causes a valve in the body to open;

iv. opening a passageway between the wellbore below the packer's body through the body and through a port to the annulus between the body and the wellbore's casing between the lowermost seal and the middle seal; and v. which passageway is then in fluid communication through a fracing port to the tubing string, permitting the packer to be inserted through a fluid at a higher speed than if the passageway was not open or not there.

In a further embodiment is provided a method where the valve is caused to close by movement of the packer uphole, isolating the wellbore below the packer from the fracing zone between the uppermost and middle seals for fracing.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
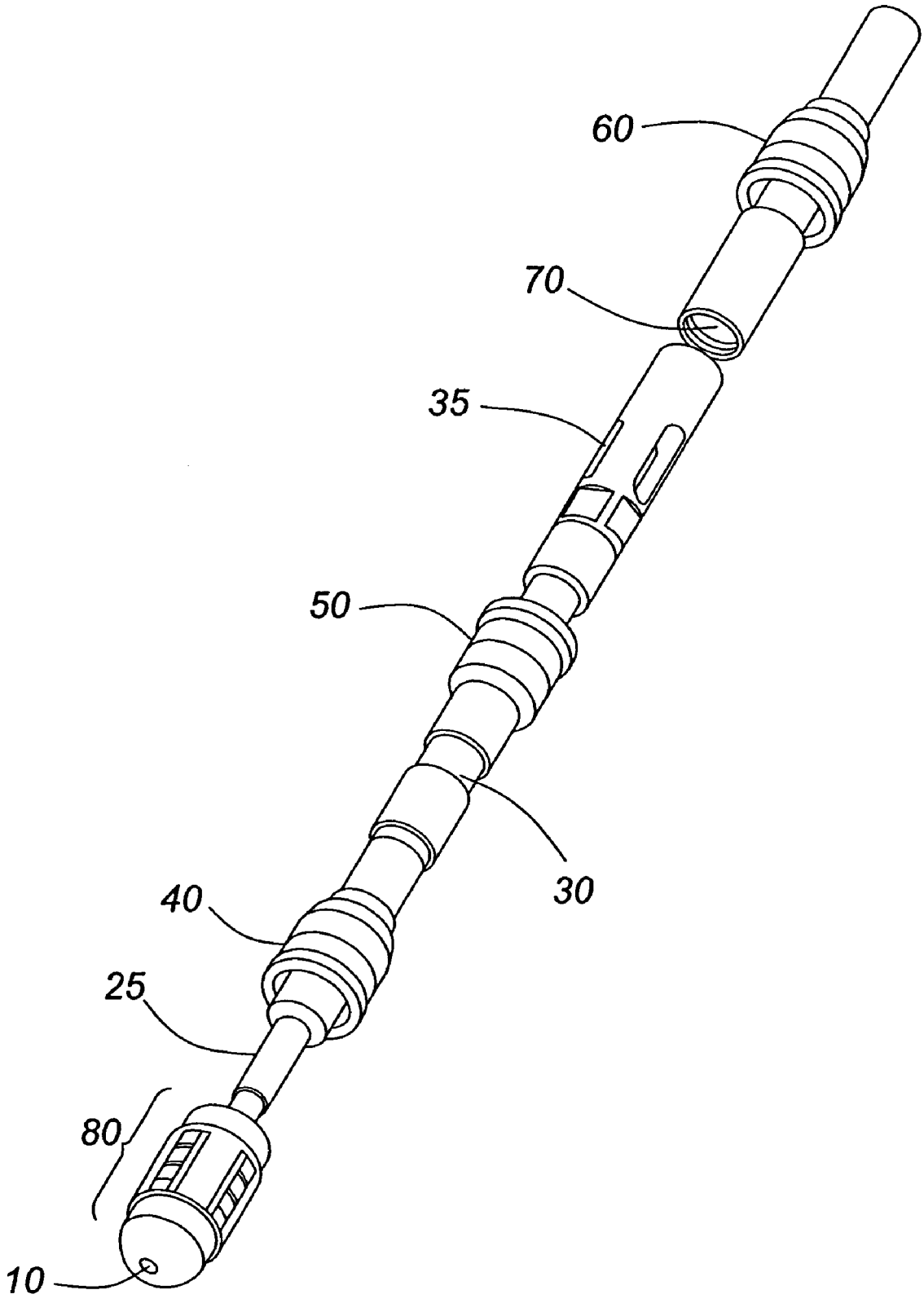
FIG. 1 is a perspective drawing of the tool.
Figure 2:
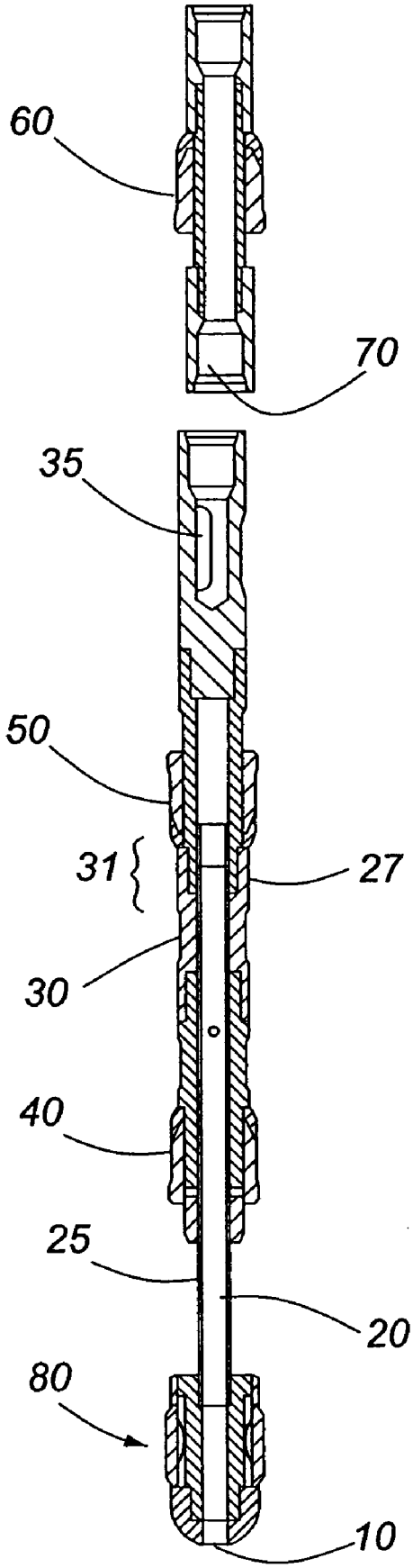
FIG. 2 is a cutaway drawing showing a cross-section of the tool along a plane which intersects the tool diametrically along its longitudinal axis.

This invention provides for a valve which when run down a wellbore opens a passage to bypass the lower seals of the tool through which water or similar fluid in the wellbore may pass as the tubing and packing tool are lowered down the well-bore through the wellbore water or similar fluid, and which can selectively be closed when the packer and tubing string is placed where desired, thus providing isolation of a fracing zone from zones both above and below the stimulation operation. This permits the tool to be run into a wellbore through fluids in the wellbore without the usual hydraulic resistance encountered when using a tool from the prior art.

The valve is included in a tool on the lower end of a tubing string for use in fracturing or stimulating a well using high pressure fluid. The valve assembly is open while being inserted into the well-bore on the lower end of the tubing, and provides a passageway from below the tool through an opening in the tool's bottom end 10 then through a passage 20 formed by a hollow mandrel 25 through a port 27 at the top end of the mandrel 25 and through a port 30 on the exterior of the tool, thus bypassing the cup-seal 40 which would ordinarily seal the annulus between the tool and the well's casing by virtue of pressure exerted by fluid on the lower side of the cup-seal 40, the passageway continuing then in the annulus between the tool and the casing past upward-facing cup-seal 50 through frac ports 35 into the hollow centre of the upper end of the tool 70, bypassing cup-seal 60, and into the tubing string to which the tool is attached when in operation (not shown).

The valve mechanism comprises the drag body 80, hollow mandrel 25, internal port 27, the inside surface of a mating cavity inside the tool's lower body 31 which encloses and slideably receives the hollow mandrel 25, and then through the port(s) 30. When the hollow mandrel 25 is drawn out of the cavity in the tool's lower body 31 a predetermined distance, the internal port 27 is sealed against the inside of the tool's lower body cavity 31 enclosing the hollow mandrel, causing the passageway above-described to be closed to the passage of fluid.

During running-in of the tool down the wellbore, the passageway of the tool is open, but when it is desirable to close the passageway to isolate that portion of the wellbore below the fracing zone, which is around 35 between cup-seal 60 and cup-seals 40 and 50 acting together, the tubing string is stopped in its downward (into hole) movement and pulled upward (out of hole), causing the drag body 80 to exert a downward force on the attached hollow mandrel 25, moving it out of the tool's lower body, around 31, which encloses and slideably receives the mandrel 25, a predetermined distance, sliding the internal port 27 down past the port 30, sealing the tool closed. Running the tool back downward reverses the force exerted by the drag body 80, and moves the drag body and mandrel 25 such that the internal port 27 can communicate fluid through port 30, opening the passageway and permitting fluid below the tool to flow past the tool when run further into the wellbore. The drag body 80 exerts force in this embodiment, by friction of wipers against the casing. The force exerted by the drag body is, in a preferred embodiment, approximately 400 pounds, but an appropriate amount of drag will be determined by very simple experimentation.

The valve can be run into the hole in an open configuration, then closed by the above-described operation for the fracing operation, and then again opened when the tool is again lowered, and thus is a controllable "dual stage" valve (open, closed).

Should the valve fail to close, the cup-seal 60 isolates the lower-pressure uphole zone from the high pressure fracing zone, and the cup-seal 50 isolates the higher pressure fracing zone from the zone below cup-seal 50, and so still isolates the stimulation at the fracing zone around 35 from the lower-pressure other portions of the well-bore, and so the stimulation service can continue to be carried out regardless of valve position. The dual stage straddle packer is, to that extent, "fail-safe", and will not ordinarily cause the requirement to trip out of the wellbore in the event of a failure of the valve.

The tool has the added benefit over other types of valves (such as ball-and-seat valves) which might be deployed in its place, of providing large cross sectional areas of flow, and high flow rates, and being isolated entirely below cup-seal 50 from the high pressure fluid and additives introduced during fracing.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention.

What is claimed is:

1. A dual-stage valve straddle packer for insertion into a wellbore and delivery of fracing and stimulation service to a particular zone of the wellbore comprising:

a. a body operatively connected to a tubing string, with fluid communication to the inner bore of the tubing;

b. the body having an upper cup-seal for isolation of fluid delivered under pressure through fracing ports in the body below the upper cup-seal by sealing the annulus between the body and a casing of the wellbore;

c. the body having a set of lower cup-seals for isolation, by a top lower cup-seal of the fracing ports from the wellbore below the top lower cup-seal, and by a bottom lower cup-seal of the wellbore below the bottom lower cup-seal from the fracing ports, each of the lower cup-seals being a one-way seal sealing a higher pressure side from a lower pressure side, the lower cup-seals deployed to seal the annulus between the body and the wellbore's casing;

d. a passageway from the wellbore below the bottom lower cup-seal through the body and a valve to ports in the body in fluid communication when the valve is open with the annulus between the body and the wellbore's casing at a point above the bottom lower cup-seal and below the upper cup-seal;

e. the valve being capable of opening and closing, responsive to a movement of the body in the wellbore, where an upward movement will close the valve and a downward movement will open the valve.

2. The dual-stage valve straddle packer of claim 1 wherein the valve is a pressure balanced valve.

3. A method of inserting a straddle packer for isolation of a fracing service in a tracing zone from zones in a wellbore above and below the fracing zone, comprising the steps:

a. where the straddle packer has three uni-directional seals, sealing flow from high pressure side to low pressure side, the uppermost seal sealing the low pressure wellbore zone above the tool from a high pressure fracing zone below the uppermost seal; a middle seal sealing the high pressure fracing zone above the middle seal from a low pressure wellbore zone below the middle seal, and a lowermost seal sealing a high pressure wellbore zone below the lowermost seal from a low pressure fracing zone, the seals being seals when the relative pressures are as stated;

b. where the straddle packer has a body, and a valve capable of opening and closing, responsive to a movement of the body in the wellbore, inserting the straddle packer into the wellbore, and applying a downhole movement, wherein the downhole movement causes the valve to open;

c. opening a passageway between the wellbore below the packer's body through the body and through a port to the annulus between the body and the wellbore's casing between the lowermost seal and the middle seal;

d. which passageway is then in fluid communication through a fracing port to the tubing string.

4. The method of claim 3 where the valve is caused to close by movement of the packer uphole, isolating the wellbore below the packer from the fracing zone between the uppermost and middle seals for fracing.

* * * * *